United States Patent [19]

Kranser

[11] 4,419,436

[45] Dec. 6, 1983

[54] PHOTOSENSITIVE PLATE

[76] Inventor: Leonard S. Kranser, 1718 Elevado Ave., Arcadia, Calif. 91106

[21] Appl. No.: 341,871

[22] Filed: Jan. 22, 1982

[51] Int. Cl.[3] ..... G03C 5/04; G03C 5/54

[52] U.S. Cl. ..... 430/260; 430/256; 430/259; 156/230; 156/239; 156/240; 156/249; 428/40; 428/202; 428/204; 428/207; 428/354; 428/914

[58] Field of Search ..... 430/256, 257, 259, 260; 428/40, 202, 203, 204, 914, 207, 354; 156/249, 344, 230, 233, 239, 240, 234

[56] References Cited

U.S. PATENT DOCUMENTS 2,455,777 12/1948 Jones ..... 428/204
4,103,053 7/1978 Barehas ..... 428/40

OTHER PUBLICATIONS

Neltape Product Information Bulletin—Dielectric Polymers, Inc.
3M Photosensitive Products, pp. 34-7007-1317-4 and 34-7007-1202-8.
"KDP", Kimoto U.S.A., Inc.
Kimoto KDP, Technical Graphics, Inc. Product Information Bulletin.
ScotchMark Identification Systems Selection Guide, 3M, Catalog SB-VSG (120.5)11.

*Primary Examiner*—Mary F. Downey
*Attorney, Agent, or Firm*—Lyon & Lyon

[57] ABSTRACT

A kit for preparing a mountable plate having an image thereon, such as a nameplate, includes light sensitive film and a colored adhesive mounting element. The film includes a polymeric base, a clear polymeric protective overlay, and a light sensitive layer between the base and the overlay. The mounting element includes a clear adhesive layer for attaching to the film and a colored layer that provides color to the assembled nameplate. The mounting element can also include pressure-sensitive adhesive so that the nameplate can be attached to a surface.

There is also described a method for preparing a nameplate using this kit.

29 Claims, 4 Drawing Figures

PHOTOSENSITIVE PLATE

BACKGROUND

The present invention relates to kits and methods for preparing mountable plates having an image thereon, such as nameplates.

To prepare a nameplate, many prior art processes utilize a lithographic printing plate or silkscreen. These techniques are capable of preparing high quality nameplates. However, they require skilled labor and a long time to prepare a nameplate. Thus, they are expensive and particularly unsuitable for short runs.

Photosensitive nameplate systems are known. For example, 3M markets a Scotchal TM photosensitive label. A difficulty with the Scotchal system is that is requires a photosensitive developer which can have adverse health consequences in the event of overexposure. Moreover, the developed name plate has the image on its surface and has no abrasion protection. If abrasion protection is required, it is necessary to either spray on a coating or laminate a coating over the image, which is an additional time consuming step.

Thus, there is a need for a photosensitive label system that overcomes the disadvantages of prior art systems.

SUMMARY

The present invention provides a system for producing high quality pressure sensitive adhesive image plates, including nameplates and labels. The system does not require any chemicals to develop the image formed. Moreover, the developed image includes a protective overlay so that immediate abrasion resistance is provided. The resultant product is durable and can be provided in a multitude of attractive colors.

The system is provided as a kit comprising two parts, a light sensitive film and a colored adhesive mounting element.

The light sensitive film comprises three layers laminated together:

(i) a light transmitting polymeric base;

(ii) a clear polymeric protective overlay; and (iii) a light sensitive layer sandwiched between the base and the protective overlay.

The mounting element comprises:

(i) a top protective liner, (ii) a clear adhesive layer on the underside of the top protective liner; and (iii) a color layer that can comprise a clear colorant film on the underside of the clear adhesive layer and a colorant on the underside of the colorant film.

Preferably the top protective liner is optically transmissive so that the color of the color layer can be seen.

Preferably the mounting element also includes a pressure sensitive layer on the underside of the color layer so that the nameplate can be mounted. The pressure-sensitive adhesive layer can be protected by a release layer, which preferably is moisture-resistant.

The nameplate is formed from the kit by exposing the light sensitive layer to light through a film negative and developing the image. The developed image and protective overlay are separated from the base, the top liner is removed from the mounting element, and the developed image and the mounting element with the liner removed therefrom are laminated together so that the clear adhesive layer is against the image.

In a less preferred version of the present invention, the mounting element can comprise a clear top protective liner, adhesive with color incorporated therein, and a release layer for the adhesive.

DRAWINGS

These and other features, aspects, and advantages of the present invention will become better understood with reference to the following description, appended claims and accompanying drawings where:

DESCRIPTION

The present invention will be described with respect to a kit for preparing a nameplate. However, it will be realized that the kit can be used for preparing a plate having any image thereon, including labels and the like. It should also be realized that the figures are not drawn to scale.

Figure 1A:
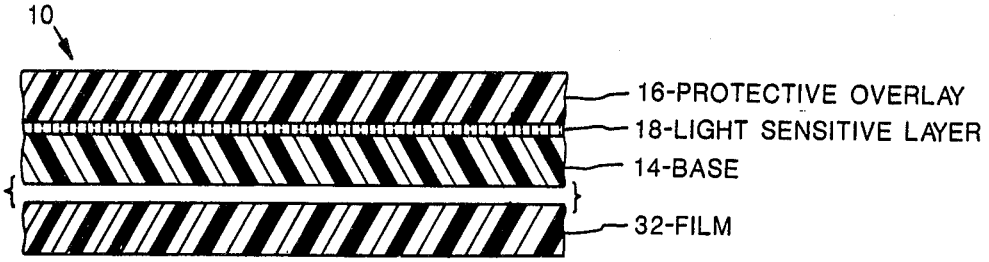
FIG. 1 shows in vertical cross section the elements of a kit for preparing a nameplate according to the present invention, FIG. 1A showing a light sensitive film and FIG. 1B showing a mounting element.
Figure 1B:
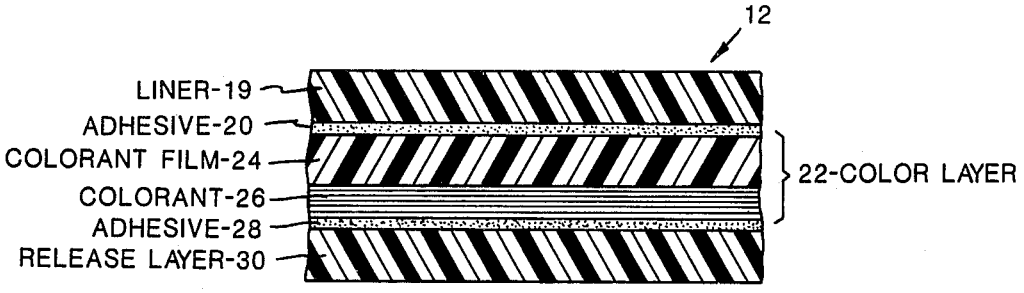
Figure 2:
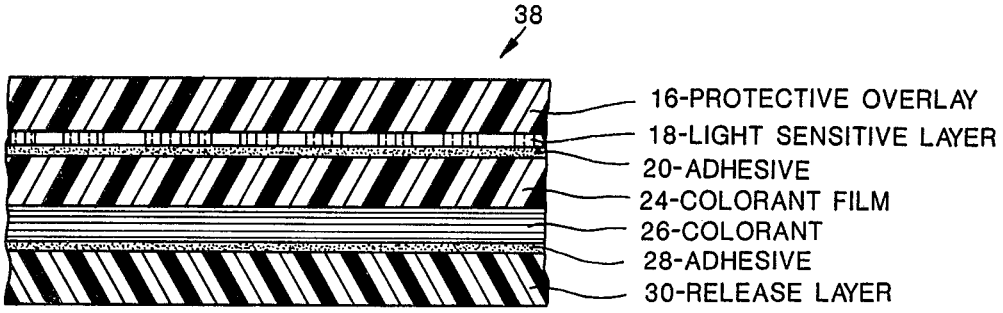
FIG. 2 shows in vertical cross section a nameplate prepared from the kit of FIG. 1.

With reference to FIGS. 1 and 2, a kit for preparing a nameplate comprises a light sensitive film 10 (FIG. 1A) and a mounting element 12 (FIG. 1B). The light sensitive film comprises three layers:

1. A light transmitting polymeric base 14;
2. A clear polymeric protective overlay 16; and
3. A light sensitive layer 18 sandwiched between the base and the overlay.

A preferred light sensitive film is KDP TM contact film provided by Kimoto & Co., Ltd. KDP film is a negative/positive bright light contact film consisting of a light sensitive aluminum layer 18 on a clear plastic overlay 16 which is made of polyester. The KDP film has high sensitivity, high resolution power (180 lines per inch), is easy to handle, and does not require chemicals for its development. The light sensitive layer 18 comprises aluminum in a polymeric base and is electrically non-conductive. The film is durable, flexible, and has a good chemical resistance. The light sensitive layer, and the opaque image formed from the light sensitive layer, are in direct contact with the protective overlay 16.

The overlay 16 is clear so that the image formed is visible.

The colored adhesive mounting element 12 preferably comprises the following layers laminated together:

1. A top protective liner 19;
2. A clear first adhesive layer 20 on the underside of the protective liner 19;
3. A color layer 22 on the underside of the adhesive layer 20, the color layer 22 comprising a clear colorant film 24 on the underside of the adhesive layer 20 and a colorant such as paint 26 on the underside of the colorant film 24;
4. A pressure-sensitive second adhesive layer 28 on the underside of the color layer 22; and
5. A release layer 30 such as release paper on the underside of the pressure-sensitive adhesive layer.

Preferably the protective liner 19 is sufficiently optically transmissive that the color of the color layer 22 can be seen, and more preferably the protective liner 19 is clear. In addition, preferably the protective liner 19 is sufficiently smooth that the first adhesive layer 20 does not have a grainy appearance which would adversely affect the appearance of the nameplate produced from the kit.

The first adhesive layer 20 needs to be clear so that the color of the color layer 26 is visible therethrough. It needs to be chemically compatible with the light sensitive layer 18 and the protective overlay 16. Moreover, it must be possible to peel the protective liner 19 from the adhesive layer 20. The adhesive layer 20 must be capable of forming a permanent bond with the protective overlay 16 and the light sensitive layer 18. Moreover, the first adhesive layer 20 should be temperature stable, non-yellowing, and preferably pressure-sensitive.

The colorant film 24 is also clear so that the color of the colorant layer 26 is visible. It needs to be compatible with whatever colorant is used, i.e. it can be coated with the colorant. Preferably it is non-yellowing and sufficiently smooth to avoid graininess in the product.

In an alternate version of the invention, the color layer 22 can have the colorant on the underside of the adhesive layer 20. In another version of the invention, the color layer can be a film with colorant incorporated into it, such as an opaque colored vinyl film.

In a preferred version of the present invention, the protective liner 19 comprises a polyester film, the first adhesive layer 20 is a high-tack, clear, acrylic, pressure-sensitive adhesive, and the colorant film 24 is a polyester film. These three layers, 19, 20 and 24, can be obtained as single product from several sources such as 3M of St. Paul, Minn. under the designation Scotch Mark TM label stock catalog number Y-7752. Y-7752 comes as a laminate of transparent polyester of 2 mils thickness which serves as the colorant film 24; a high-tack adhesive of 0.7 mils thickness which serves as the first adhesive layer 20; and a transparent polyester film liner of 1.5 mils thickness with superior smoothness which services as protective liner 19. Scotch Mark Catalog No. Y-7752 is more fully described in "Scotch Mark Identification Systems" Selection Guide, Catalog SP-DSG(120.5)11, which is incorporated herein by this reference.

The colorant 26 can be any colorant that permanently colors the colorant film 24. Suitable colorants are vinyl paints available from Nazdar of Los Angeles, Calif., available under Catalog Nos. BF-124 (orange), BR-104 (red), BF-164 (purple), and BF-111 (black). These paints can be screen painted onto the underside of the colorant film 24, and allowed to air dry overnight.

The second adhesive layer 28 needs to be one that does not adversely affect the colorant layer 26. Preferably the second adhesive 28 is a pressure-sensitive adhesive. Alternatively, it can be an adhesive that is heat-activated or activated by solvent. When the second adhesive 28 is a pressure-sensitive adhesive, a release layer 30 is required.

Preferably the release layer 30 is moisture resistant to avoid puckering from atmospheric moisture, which can result in the nameplate prepared from the kit having wrinkles.

Preferably the second adhesive layer 28 and release layer 30 are obtained as a single unit which is laminated to the underside of the colorant layer 26. A suitable combined second adhesive layer 28 and release layer 30 is obtained from sources including Dielectric Polymers, Inc. under the trade name Neltape 100AP. This product comprises a 0.002 inch thick layer of transparent acrylic adhesive on a moisture stable polyethylene/kraft liner, the adhesive serving as the second adhesive layer 28 and the polyethylene/kraft liner serving as the release layer 30.

The kit 10 is simple to use, requiring non-skilled labor and only a short amount of time. The details of the processing instructions are found in "Fotofoil® P-Photo Plastic Processing Instructions", Miller Dial Corp. El Monte, Calif., 9/9/81, which is incorporated herein by this reference. The process involves exposing the light sensitive film to ultraviolet light provided by an arc lamp, a metal halide source, pulsed xenon source, or a fluorescent tube. A film negative 32 is placed against the base 14 of the light sensitive film. The film should have a positive of the desired image. Clear areas on the film 32 give silver images on the light sensitive layer 18 and black areas on the film 32 give clear areas on the light sensitive layer. After the light sensitive film 10 is exposed to light, it is developed. Developing can be accomplished without dangerous chemicals, using hot water at a temperature of 140° F.±5° F. for only sixty seconds.

After developing, the protective overlay 16 with silver portions of the light sensitive layer 18 is separated from the base 14, which is discarded.

The top film liner 19 is then removed from the mounting element 12. The mounting element is then laminated against the developed light sensitive layer 18 with the first adhesive layer 20 laminated to the light sensitive layer.

The resultant nameplate 38 is shown in FIG. 2. To use the nameplate, the release layer 30 is removed therefrom, thereby exposing the pressure sensitive adhesive 28. Then the nameplate 38 can be mounted in place.

Figure 3:
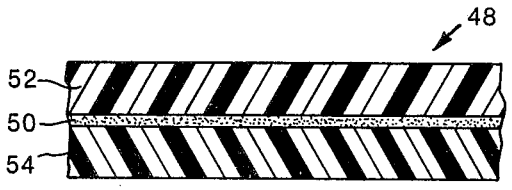
FIG. 3 shows in vertical cross section a mounting element according to a different version of the present invention.

In a less preferred version of the present invention, instead of using the mounting element 12 of FIG. 1A, the mounting element 48 shown in FIG. 3 can be used. This mounting element combines the adhesive layer 20, colorant film 24, colorant 26, and the second adhesive layer 28 of the mounting element 12 into a single colored pressure-sensitive adhesive 50. This adhesive is laminated between a top film liner 52 and a release layer 54. In use, the top liner 52 is removed from the mounting element 48 and then the mounting element 48 is secured to the developed light sensitive film 10 with the base 14 removed therefrom. To use the resultant product, the release layer 54 is removed, thereby exposing the colored pressure-sensitive adhesive 50.

The photosensitive nameplate system of the present invention has substantial advantages compared to prior art systems. It permits the direct printing of labels and nameplates from film, thereby eliminating the need to produce lithographic printing plates or silk screens. Thus, lower skilled labor and a fraction of the time necessary for the production of short runs by non-photosensitive techniques are required.

Further, processing requires no chemicals, only needing hot water and can be conducted in normal room light.

In addition, the nameplates produced have superior durability because the developed image is always protected by the protective overlay 16. The final product is chemical resistant, flexible and has an excellent appearance. A further advantage of the present invention is that the image is in direct contact with the protective overlay so that no foreign materials or bubbles due to poor adhesion at the interface between the image and the protective overlay can occur.

In addition, the system is extremely versatile because the kit includes two components, and thus a virtually unlimited number of color combinations are possible.

This invention provides the first photosensitive process for producing nameplates with a colored adhesive backing and an opaque image directly in contact with a protective overlay. Further, the present invention provides the first photosensitive plastic nameplate with a colored background having a built-in protective overlay.

Although the present invention has been described in considerable detail with reference to preferred version thereof, other versions are possible. For example, the top film liner 18 can be textured so that the final product has a matte finish. Therefore, the present invention should not be limited to the description of the preferred version contained herein.

What is claimed is:

1. A kit for preparing a mountable image plate comprising:

(a) a light sensitive film comprising:
  (i) a light transmitting polymeric base,
  (ii) an optically clear, polymeric protective overlay, and
  (iii) a light sensitive layer between the base and the overlay; and (b) a mounting element for the light sensitive film after the film has been developed and the polymeric base has been removed, the mounting element comprising:
  (i) an optically transmissive top protective liner,
  (ii) a clear first adhesive layer on the underside of the top protective layer,
  (iii) a color layer comprising a clear colorant film on the underside of the first adhesive layer and colorant on the underside of the colorant film,
  (iv) a pressure-sensitive second adhesive layer on the underside of the colored layer; and
  (v) a moisture resistant release layer on the underside of the pressure-sensitive adhesive layer, wherein the top protective layer can be removed from the first adhesive layer and the release layer can be removed from the second adhesive layer.

2. A kit for preparing a mountable image plate comprising:

(a) a light sensitive film comprising
  (i) a light transmitting polymeric base,
  (ii) a clear, polymeric protective overlay, and
  (iii) a light sensitive layer between the base and the overlay; and (b) a colored adhesive mounting element for the light sensitive film after the film has been developed and the polymeric base has been removed therefrom.

3. The kit of claim 2 in which the mounting element comprises:

(i) a top protective liner; and
(ii) a colored adhesive layer.

4. The kit of claim 2 in which the mounting element comprises:

(i) a top protective liner,
(ii) a clear first adhesive layer on the underside of the top protective liner;
(iii) a color layer on the underside of the first adhesive layer; and
(iv) a second adhesive layer on the underside of the color layer.

5. The kit of claim 4 in which the second adhesive layer is a pressure-sensitive adhesive, the mounting element also including a release layer on the underside of the second adhesive layer.

6. The kit of claim 3 or 4 in which the top protective liner is optically transmissive.

7. The kit of claim 3 in which the colored adhesive is pressure-sensitive and the mounting element includes a release layer on the underside of the colored adhesive layer.

8. The kit of claim 1 or 2 in which the light sensitive layer comprises aluminum in a polymeric base, wherein the light sensitive layer is electrically non-conductive.

9. A colored mounting element for a light sensitive film, the mounting element comprising:

(i) a top protective liner;
(ii) a clear first adhesive layer on the underside of the top protective liner;
(iii) a color layer on the underside of the first adhesive layer; and
(iv) a second adhesive layer on the underside of the color layer.

10. The kit of claim 4 in which the color layer comprises a clear colorant film on the underside of the first adhesive layer and colorant on the underside of the colorant film.

11. The kit of claim 4 in which the color layer comprises a colored polymeric film.

12. The kit of claim 4 in which the color layer comprises a colorant on the underside of the first adhesive layer and a colorant film on the underside of the colorant.

13. The mounting element of claim 9 in which the second adhesive layer is a pressure-sensitive adhesive, the mounting element including a release layer on the underside of the second adhesive layer.

14. The mounting element of claim 13 in which the release layer is moisture-resistant.

15. The mounting element of claim 9 in which the top protective liner is optically transmissive.

16. A mountable image plate comprising:

(a) an optically clear, polymeric protective overlay;
(b) a developed image on the underside of the protective overlay;
(c) a color layer secured to the image by a clear adhesive, the color layer comprising a clear colorant film secured to the underside of the image and colorant on the underside of the colorant film;
(d) a pressure-sensitive adhesive on the underside of the color layer; and
(e) a moisture-resistant release layer on the underside of the pressure-sensitive adhesive.

17. The plate of claim 13 in which the developed image comprises aluminum in a polymer base and the image is electrically non-conductive.

18. A mountable image plate comprising:

(a) a clear, polymeric protective overlay;
(b) a developed image on the underside of the protective overlay;
(c) a first adhesive layer on the underside of the image;
(d) a color layer on the underside of the first adhesive layer; and
(e) a second adhesive layer on the underside of the color layer.

19. The plate of claim 18 in which the color layer comprises a clear film secured to the first adhesive layer and colorant on the underside of the clear film.

20. The plate of claim 18 in which the color layer comprises a colored polymeric film.

21. The plate of claim 18 in which the color layer comprises colorant on the underside of the first adhesive layer and a colorant film on the underside of the colorant.

22. A method for preparing a plate having an image thereon comprising the steps of:

(1) selecting a kit comprising (a) a light sensitive film comprising:

(i) a light transmitting polymeric base, (ii) a clear, polymeric protective overlay, and (iii) a light sensitive layer between the base and the overlay; and (b) a mounting element for the light sensitive film after the film has been developed and the polymeric base has been removed, the mounting element comprising:

(i) an optically transmissive top protective liner, (ii) a clear first adhesive layer on the underside of the top protective layer, (iii) a color layer on the underside of the first adhesive layer, (iv) a pressure-sensitive second adhesive layer on the underside of the colored layer, and (v) a moisture resistant release layer on the underside of the pressure-sensitive adhesive layer, wherein the top protective layer can be removed from the first adhesive layer and the release layer can be removed from the second adhesive layer;

(2) exposing the light sensitive layer to light through a film and developing the resultant image;

(3) separating the developed image and protective overlay from the base;

(4) removing the liner from the mounting element; and (5) laminating the mounting element with the liner removed therefrom to the image with the first adhesive layer against the image, thereby forming a colored plate with the image protected by the polymeric protective overlay.

23. The mounting element of claim 9 in which the color layer comprises a clear colorant film on the underside of the first adhesive layer and colorant on the underside of the colorant film.

24. The mounting element of claim 9 in which the color layer comprises a colored polymeric film.

25. The mounting element of claim 9 in which the color layer comprises a colorant on the underside of the first adhesive layer and a colorant film on the underside of the colorant.

26. The kit of claim 1 or 2 in which the film is a contact film in which the light sensitive layer is electrically non-conductive and comprises aluminum in a polymeric base.

27. The kit of claim 26 in which the overlay is made of polyester.

28. The method of claim 22 in which the film is a contact film and the light sensitive layer is electrically non-conductive and comprises aluminum in a polymeric base.

29. The method of claim 28 in which the overlay is made of polyester.

* * * * *